US008079866B2

(12) United States Patent
Langhoff et al.

(10) Patent No.: US 8,079,866 B2
(45) Date of Patent: Dec. 20, 2011

(54) RECEIVING DEVICE FOR ACCOMMODATING A CONNECTOR

(75) Inventors: Wolfgang Langhoff, Leonberg (DE); Michael Knödler, Gerlingen (DE)

(73) Assignee: Amphenol-Tuchel Electronics GmbH, Heilbronn (DE)

( * ) Notice: Subject to any disclaimer, the term of this patent is extended or adjusted under 35 U.S.C. 154(b) by 0 days.

(21) Appl. No.: 12/742,534

(22) PCT Filed: Nov. 6, 2008

(86) PCT No.: PCT/EP2008/009342

§ 371 (c)(1), (2), (4) Date: Aug. 26, 2010

(87) PCT Pub. No.: WO2009/062625

PCT Pub. Date: May 22, 2009

(65) Prior Publication Data

US 2010/0311271 A1 Dec. 9, 2010

(30) Foreign Application Priority Data

Nov. 16, 2007 (DE) ..... 20 2007 016 140 U
Nov. 16, 2007 (EP) ..... 07022270

(51) Int. Cl.
*H01R 31/08* (2006.01)

(52) U.S. Cl. ..... 439/509

(58) Field of Classification Search ..... 439/509, 439/512, 698, 620.28–620.34; 337/194, 337/245

See application file for complete search history.

(56) References Cited

U.S. PATENT DOCUMENTS

| | | | | |
|---|---|---|---|---|
| 2,481,893 | A | | 9/1949 | Wilcox |
| 5,588,876 | A | | 12/1996 | Hayes et al. |
| 5,700,165 | A | * | 12/1997 | Harris et al. ..... 439/620.26 |
| 5,859,580 | A | * | 1/1999 | Hashizawa et al. ..... 337/260 |
| 5,941,730 | A | | 8/1999 | Uchiyama et al. |

FOREIGN PATENT DOCUMENTS

| | | | |
|---|---|---|---|
| DE | 197 38 772 | A1 | 3/1998 |
| DE | 200 00 160 U | U1 | 3/2000 |
| DE | 10 2004 037 277 | A1 | 3/2006 |
| DE | 10 2006 012 337 | B3 | 11/2007 |
| EP | 1 139 373 | A2 | 10/2001 |
| FR | 2063804 | A5 | 7/1971 |
| WO | 92/22945 | A1 | 12/1992 |

* cited by examiner

*Primary Examiner* — Phuong Dinh

(74) *Attorney, Agent, or Firm* — Blank Rome, LLP

(57) ABSTRACT

The invention relates to a receiving device (1) for receiving and locking two connectors that consist of sockets (52, 52') and plugs (51, 51'), and a fuse (60) arranged between the sockets (52, 52') as a current-carrying element for protecting the connection established by the receiving device (1) and the connectors. The receiving device comprises a top part (64) for receiving the plugs (51, 51'), a base (62), which can be connected to the top part (64) to contact the connectors, for receiving the sockets (52, 52') and the fuse (60), said fuse (60) being arranged in the receiving device in such a manner that the fuse (60) is immobilized in the receiving device (1) in the position of contact of the connectors.

15 Claims, 3 Drawing Sheets

RECEIVING DEVICE FOR ACCOMMODATING A CONNECTOR

CROSS-REFERENCE TO RELATED APPLICATIONS

The present application claims the benefit of International Patent Application No. PCT/EP2008/009342, filed Nov. 6, 2008, which in turn claims priority to EP patent application Ser. No. 0702270.8 filed Nov. 16, 2007, and DE patent application Ser. No. 20 2007 016 140.9 filed Nov. 16, 2007, the entire disclosures are incorporated by reference herein.

BACKGROUND OF THE INVENTION

1. Field of Invention

This invention relates to a receiving device for accommodating a connector.

2. Description Of The Related Art

In conventional connectors which can be accommodated in a receiving device or which are protected against ambient effects by way of a receiving device, are on the one hand conventionally fixed by latch connections which act opposite the insertion direction or latch connections which act opposite the joining direction of the plug and socket, often a secondary interlock being additionally provided in order to prevent detachment of the plug from the socket as much as possible [sic]. The latch connections must be made stable and are designed to prevent release of the connector even over a longer service life, especially creep of the plastic material arising as a technical problem.

Receiving devices of the generic type are used especially in the detachable linking of electrical or electronic devices which are required for operation of a vehicle with an electric or electrically supported drive, for example hybrid vehicles. The particularity in these applications is that considerable currents flow through the connector. Furthermore there is the constraint that the connector must be able to accommodate very high forces in the insertion and/or joining direction. In known connectors or receiving devices for connectors these forces are often accommodated via an additional locking clip.

Moreover a fuse as a current carrying element should be provided in the line set and in the case of exceeding a given voltage value and/or current value breaks the electrical connection between the current generator and the collector. In this case the fuse must be replaced by a new fuse. When the fuse is replaced there is the serious danger that the operator will come into contact with the possibly still energized poles of the current generator, for example of a hybrid drive, and in doing so will be exposed to a current shock.

Therefore one skilled in the art is faced with the task of configuring the receiving device for a plug and socket connection such that a fuse installed in the line set can be easily replaced without the danger of an electrical shock in case of protection.

Moreover one skilled in the art is faced with the task of creating a functionally simple possibility by which a connector can be safely and easily inserted and at the same time high forces can be accommodated in the insertion and/or joining direction.

SUMMARY OF THE INVENTION

This object is achieved with the features of claims 1 and 15. Advantageous developments of the invention are given in the dependent claims. The framework of the invention also encompasses all combinations of at least two of the features given in the specification, the claims, and/or the figures.

The invention is based on the idea of providing a receiving device in which a fuse can be held integrated together with a plug and socket connection. The receiving device is set up such that the fuse can be removed only after the plug and socket connection or line set has been interrupted.

This is achieved in that the receiving device consists of two components, of which one holds the plugs of the plug and socket connection and the other holds the sockets of the plug and socket connection such that the fuse is held by plugging the components together on the one hand within the receiving device—and thus inaccessibly from the outside—and on the other the plug and socket connection is coupled or separated by mating or detaching the components.

In other words: The fuse cannot be dismounted when—aside from possible destruction of the fuse—there is a current-carrying connection between the current generator and the current collector. To replace the fuse therefore the plug and socket connection must always first be separated so that the circuit is not closed by the electrician even when the two poles are touched.

The receiving device for accommodating and locking two connectors consisting of plugs and sockets and a fuse located between the sockets as a current carrying element for protection of the plug and socket connection formed by the receiving device and the connector can therefore consist of a top part for holding the plugs and a bottom part which can be connected to the top part for making contact with the connector for holding the sockets and the fuse, and the fuse can be arranged in the receiving device such that the fuse in the contact position of the connectors is fixed in the receiving device, especially undetachably.

In addition, the invention is based on the independent idea of providing a receiving device whose housing is not fixed in the joining and/or the insertion direction of the connector, but the connector is inserted into a form-fit receiver and is held optionally in position by latching which can be accomplished comparatively weakly.

Due to the considerable form-fit very high forces can be accommodated in the insertion direction and/or the joining direction which cannot be accomplished with conventional latching or only with high effort, for example an additional locking clip. In this invention an additional locking clip can be omitted.

In one advantageous configuration of the invention it is provided that the fuse can be removed in one separation position of at least one connector. It is sufficient that one of the plug and socket connections is interrupted, but advantageously both plug and socket connections are interrupted since this can be carried out mechanically more easily.

Advantageously the receiving device has plug fixing features which act transversely to the insertion direction SR of the connector in one insertion position and receiving contours which correspond to the plugs for accommodating the plugs, the receiving contours in the insertion position of the plugs comprising plug stops which act in the insertion direction SR.

One configuration of the invention is especially space-saving in which the receiving contours for holding the plugs are located on the top of the top part of the receiving device and there is a connection region for the sockets in the bottom of the top part of the receiving device, which bottom is located backward to the top.

In one advantageous configuration of the invention the especially L-shaped plugs can be pushed transversely, especially roughly 90°, to the insertion direction SR into the receiving contours, especially along the lengthwise extensions LE of the plugs, preferably in the direction of the line set terminals of the plugs. Due to this configuration of the receiving device the plug can be easily pushed into the receiving device and reduced solely by the geometrical shape of the receiving device by further degrees of freedom, especially against the insertion direction SR or the joining direction of the L-shaped plug with the socket.

Advantageously the fixing features are made as latch connections which act especially on the outside contours of the plugs. In this way the L-shaped plug is even fixed in the receiving device without the socket plugged into the receiving device so that fault-free assembly is ensured.

The fixing feature can be formed especially easily by two opposite catch projections at a time which can be latched to the L-shaped plugs in their insertion position.

A configuration is especially advantageous in which the latch projections are arranged such that they can be latched to known, existing projections on the especially L-shaped plugs, the projections being especially suitably housing latch elements of the L-shaped plug.

The plug stops which act against the insertion direction SR are formed advantageously from at least one clip which extends behind the L-shaped plug and which is made to extend behind the L-shaped plugs, especially in one insertion region, in the insertion position at least in the insertion direction SR of the sockets.

In order to be able to advantageously insert a line set which has struck the L-shaped plug into the receiving device or to route it through, the plug stops are each formed from two clips which are angled in a L-shape and which extend behind the L-shaped plugs, the ends of the clips being arranged opposite and there being a gap between the ends.

The assembly of the receiving device can be accelerated by the receiving contours being arranged to run in opposite directions, especially offset obliquely to one another, preferably roughly parallel.

Advantageously the bottom part can be removed from the receiving device by the former having a carrier which can be inserted into the cavity, especially which can be locked into the terminal device by way of peripheral latch means.

The bottom part is made especially space-saving and easily mounted/dismounted when the sockets each have one, especially cylindrical plug-in receiver, which are aligned preferably flush to one another and opposite one another in the bottom part, and the fuse, especially as a cylindrical high current fuse, can be accommodated between the two plug-in receivers.

Due to the considerable form-fit very high forces can be accommodated in the insertion direction and/or the joining direction which cannot be accomplished with conventional latching or only with high effort, for example an additional locking clip. In this invention an additional locking clip can be omitted.

The receiving device is advantageously made such that on the one hand due to the shape of the receiving device and on the other due to the mutual insertion contour unintentional detachment is essentially precluded even for very high forces in the joining and/or insertion direction.

The receiving device is advantageously made without components which can be moved, especially pivoted, against one another, by which the production costs and fault susceptibility of the receiving device are reduced.

The fixing features of the L-shaped plugs, which features act transversely to the insertion direction SR of the connectors, can be formed by the plug and socket connection of the sockets and L-shaped plugs, which connection acts transversely to the insertion direction SR of the connectors in interplay with the accommodation of the sockets in the receiving device.

The receiving contours of the receiving device correspond to the L-shaped plugs such that they can be inserted as far as into the insertion position into the receiving device, but moreover do not have further degrees of freedom.

The receiving device is advantageously made such that on the one hand due to the shape of the receiving device and on the other due to the mutual insertion contour unintentional detachment even with very high forces in the joining and/or insertion direction is essentially precluded.

The receiving device is advantageously made without components which can move, especially pivot, against one another, by which the production costs and fault susceptibility of the receiving device are reduced.

The fixing feature of the L-shaped plug which acts transversely to the insertion direction SR of the connector can be formed by the plug and socket connection of the sockets and L-shaped plugs which acts transversely to the insertion direction SR of the connector in interplay with the accommodation of the sockets in the receiving device.

The receiving contour of the receiving device corresponds to the L-shaped plug such that it can be inserted as far as into the insertion position into the receiving device, but moreover does not have further degrees of freedom.

In one advantageous configuration of the invention the L-shaped plug can be inserted transversely, especially roughly 90°, to the insertion direction SR into the receiving contour, especially along the longitudinal extension of the L-shaped plug, preferably in the direction of the line set terminal of the L-shaped plug. Due to this configuration of the receiving device the plug can be easily pushed into the receiving device and reduced solely by the geometrical shape of the receiving device by further degrees of freedom, especially against the insertion direction SR or the joining direction of the L-shaped plug with the socket.

Advantageously the fixing feature is made as a latch connection which acts especially on the outside contour of the plug. In this way the L-shaped plug is fixed in the receiving device even without the socket plugged into the receiving device so that fault-free assembly is ensured.

The fixing feature can be formed especially easily by two opposite catch projections at a time which can be latched to the L-shaped plug in its insertion position.

A configuration is especially advantageous in which the catch projections are arranged such that they can be locked to known, existing projections on the especially L-shaped plug, the projections being especially suitably housing latch elements of the L-shaped plug.

The plug stop which acts against the insertion direction SR is advantageously formed from at least one clip which extends behind the L-shaped plug and which is made to extend behind the L-shaped plug, especially in one insertion region, in the insertion position at least in the insertion direction SR of the socket.

In order to be able to advantageously insert a line set which has struck the L-shaped plug into the receiving device or to route it through, the plug stop is formed from two clips which are angled in a L-shape and which extend behind the L-shaped plugs, the ends of the clips being arranged opposite and there being a gap between the ends.

The assembly of the receiving device can be accelerated by there being two receiving contours for holding two connectors or one connector with two poles, the receiving contours being arranged to run in opposite directions, especially offset obliquely to one another, preferably roughly parallel.

A configuration of the invention is especially space-saving in which the receiving contour(s) is/are located on the top of the receiving device and in the bottom of the receiving device located backward to the top there is a connection region for the socket(s).

Mounting of the socket(s) in the receiving device is facilitated by the connection region being formed from a cavity and a fuse means which has the socket(s).

Advantageously the fuse means can be removed from the receiving device by the former having a carrier which can be inserted into the cavity, especially can be latched into the connection means by way of peripheral latching means.

The fuse means is made especially space-saving and can be easily mounted/dismounted when the sockets each have one, especially cylindrical plug-in receiver which are aligned preferably flush to one another and opposite one another in the fuse means, and between the two plug-in receivers an especially cylindrical high current fuse as a current carrying element can be held for protecting the plug and socket connection which is formed by the receiving device.

An independent invention is a system of a receiving device according to the aforementioned description and a connector, especially consisting of a L-shaped plug and a socket, and a fuse, especially a high current fuse, preferably a fusible link.

Any combination of individual features of the receiving device or connector described in the specification, claims, or shown in the figures with the system can be regarded as disclosed at the same time.

Other advantages, features and details of the invention will become apparent from the following description of preferred embodiments and using the drawings.

DETAILED DESCRIPTION OF THE PREFERRED EMBODIMENTS

In the figures the same components and components with the same function are identified with the same reference numbers, other identical components being identified with an apostrophe. For the sake of clarity not all components provided twice as claimed in the invention are shown.

Figure 1:
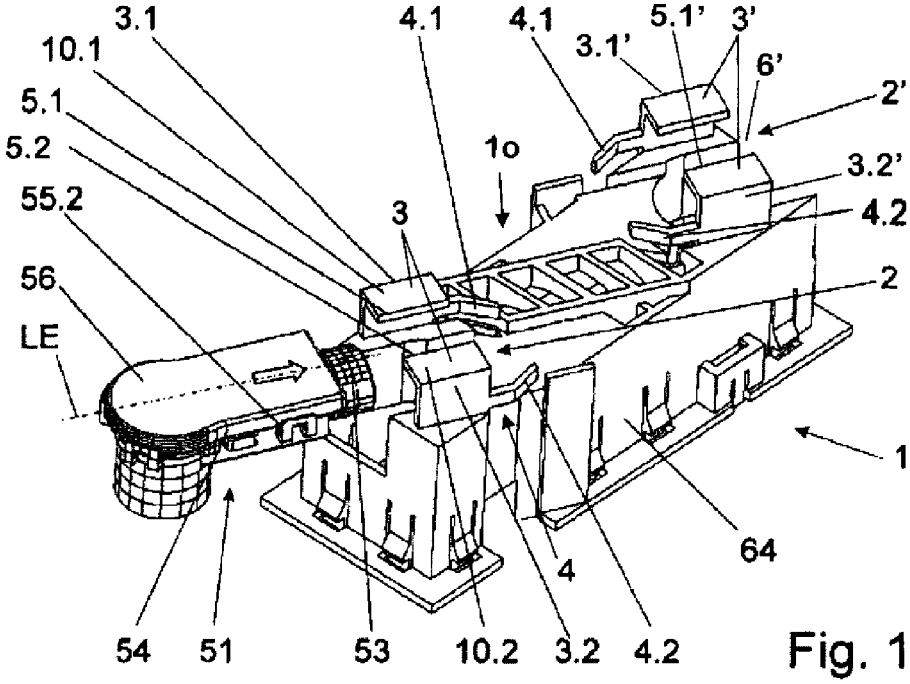
FIG. 1 shows a perspective view of a receiving device as claimed in the invention and a L-shaped plug in the insertion position, the insertion direction of the plug into the receiving device being shown by an arrow along the lengthwise extension LE of the L-shaped plug.

In FIG. 1 the top part 64 of the receiving device 1 is shown with an essentially rectangular base shape which has two receiving contours 2, 2' for accommodating two L-shaped plugs 51, 51', in FIG. 1 one of the two plugs 51, 51' being shown in the insertion position. The plug 51 is inserted more or less backwards, i.e. with the line set termination 53 of the plug 51 forward, into the receiving contour 2, and a line set which is connected to the line set terminal 53 can be routed through the receiving contour 2 in a gap 6 which has been formed in the receiving contour 2.

The receiving contour 2 corresponds essentially to the outside contour 54 of the L-shaped plug 51, the receiving contour 2 not surrounding the L-shaped plug 51 over the entire surface.

Part of the receiving contour 2 is L-shaped clips 3.1, 3.1' and 3.2, 3.2' which project up from the top 1*o* of the receiving device 1 and which are used as a plug stop 3 for the plug 51 and as a plug stop 3' for the second plug 51'. The L-shaped clips 3.1 and 3.2 each have a leg 10.1 and 10.2 which runs parallel to the top 1*o* of the receiving device 1 and which are made to extend behind the L-shaped plug 51 in the insertion region 56 of the L-shaped plug 51 in the insertion position so that the L-shaped plug 51 is blocked in its insertion position in the insertion direction SR.

Figure 2:
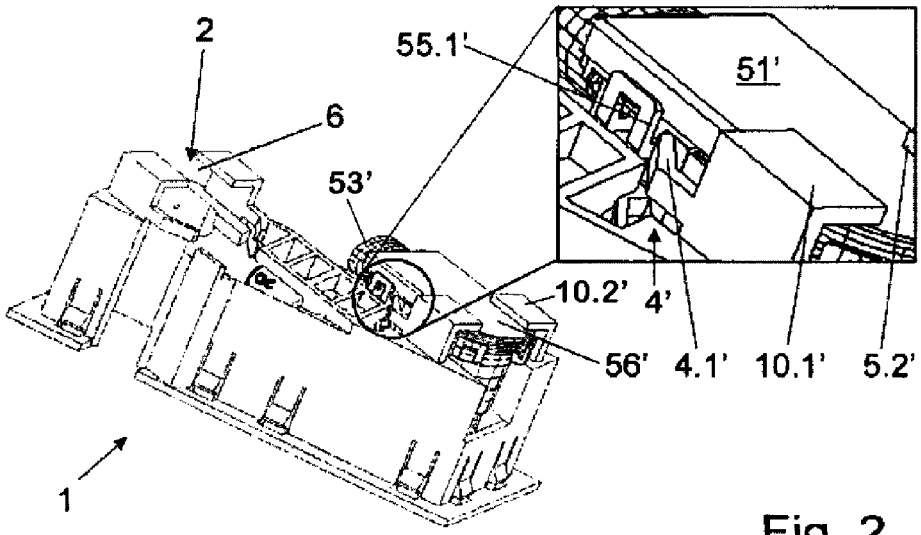
FIG. 2 shows a perspective view of a receiving device as claimed in the invention with a L-shaped plug in the insertion position and with a detail enlargement of the fixing of the L-shaped plug in the receiving device.

In the insertion position shown in FIG. 2 the L-shaped plug 51' is prevented by two opposite catch projections 4.1', 4.2' from being pulled out of the receiving contour 2' and thus out of its insertion position transversely to the insertion direction SR and along the longitudinal extension LE of the L-shaped plug 51'.

The receiving contour 2 extends at an angle $\alpha$ obliquely to the lengthwise extension of the receiving device, by which space-saving accommodation and latching of several L-shaped plugs 51, 51', here two L-shaped plugs 51, 51', are possible. One preferred angle range for the angle $\alpha$ is between 15° and 75°, more preferably between 20° and 40°.

Figure 3:
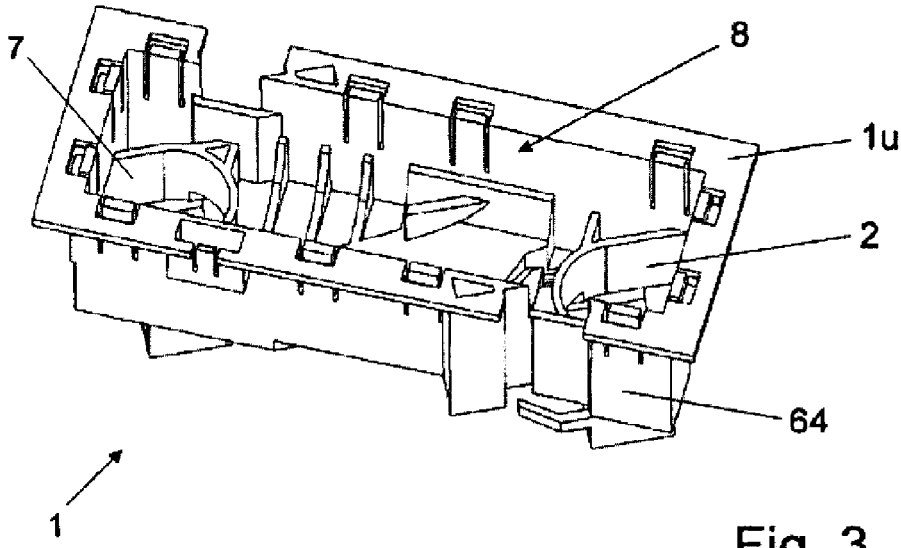
FIG. 3 shows a perspective view of a receiving device as claimed in the invention on the bottom of the receiving device.
Figure 6:
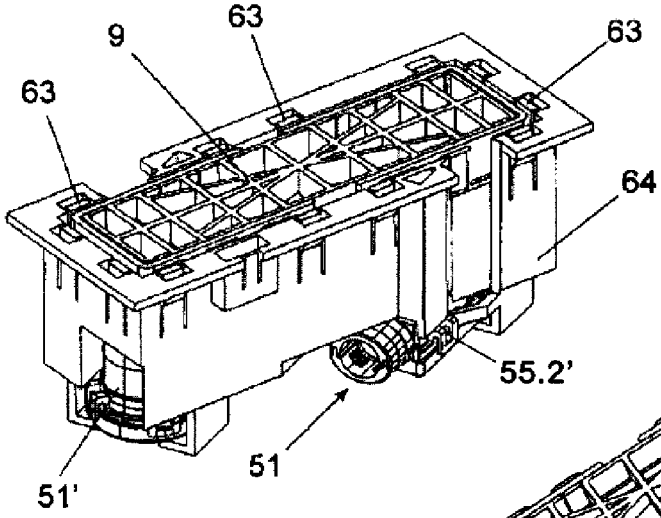
FIG. 6 shows a perspective view of the system as claimed in the invention consisting of the receiving device as claimed in the invention, two L-shaped plugs and two sockets in the insertion position
Figure 7:
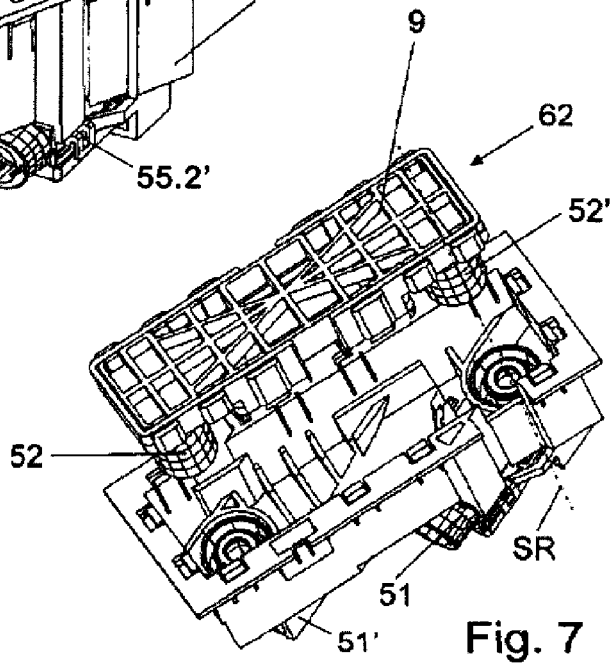
FIG. 7 shows a perspective view of the system as claimed in the invention composed of the receiving device as claimed in the invention, two L-shaped plugs and two sockets in the uninserted position.

FIG. 3 shows the receiving device 1 from underneath looking at its bottom 1*u* and the cavity 8 molded in the bottom 1*u*. In the cavity 8 a carrier 9 can be accommodated which is shown in FIGS. 6 and 7, and which holds a two-pole socket 52 or two sockets 52, 52' which correspond to the plugs 51, 51', and there can be latching of the receiving device 1 with the sockets 52, 52'. Here the latching is formed by the peripheral latch means 63 as shown in FIG. 6 between the carrier 9 and the top part 64. The carrier 9, the sockets 52, 52', a high current fuse 60 and plug-in receivers 61, 61' which hold the high current fuse 60 between themselves making electrical contact in one alternative configuration of the invention form a bottom part 62 for protecting the plug and socket connection formed by the receiving device 1 between the plugs 51, 51' by way of the sockets 52, 52'. The high current fuse 60 can be formed as a fusible link which is active only when the bottom part 62 is inserted or latched into the receiving device 1.

As a result of the geometry of the receiving device 1, the bottom part 62 can only be inserted/latched into the receiving device 1 after the two L-shaped plugs 51, 51' have been completely inserted into the receiving contour 2, 2', since otherwise the insertion geometry between the plugs 51, 51' and the sockets 52, 52' would prevent insertion of the bottom part 62 into the top part 64.

The simple mounting/dismounting capacity of the bottom part 62 out of or into the receiving device 1 advantageously makes it possible to easily replace a defective fuse 60 between the socket 52 and the socket 52' by the cylindrical high current fuse 60 which has been introduced there being unlatched and replaced by an intact fuse 60. Thus, with the receiving device 1 as claimed in the invention it has become possible to latch connectors at the same time to a fuse which is easy to replace and in doing so to be able to nevertheless accommodate considerable pulling forces in the insertion/joining direction without the plug and socket connection being released.

The high current fuse 60 can be designed such that the currents which typically flow in hybrid engines can be carried by the current carrying element, specifically the high current fuse 60, but the protective case, specifically current interruption, occurs when a defined current intensity is exceeded.

Figure 4:
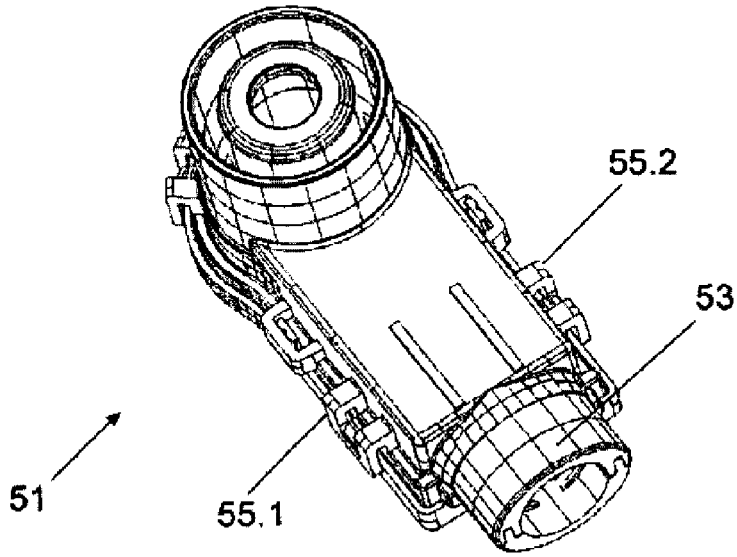
FIG. 4 shows a perspective view of the L-shaped plug.
Figure 5:
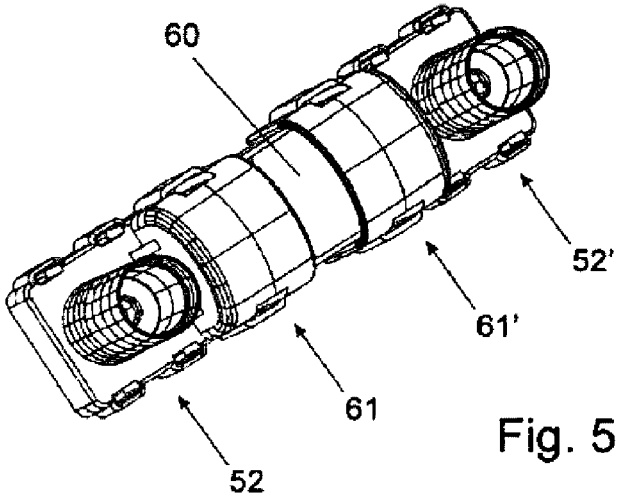
FIG. 5 shows a perspective view of the sockets with a fuse located between the sockets.

The joining process is shown in FIGS. 6 and 7, in both figures two L-shaped plugs 51, 51' in the receiving device 1 being in the insertion position and in FIG. 7 the bottom part 62 with the two sockets 52, 52' not yet being inserted, while the bottom part 62 in FIG. 6 is shown in its insertion position. In the insertion position shown in FIG. 6 the two L-shaped plugs 51, 51' are in contact with the two sockets 52, 52'. FIG. 4 shows the L-shaped plug 51 in isolation for illustration purposes.

The carrier 9, the sockets 52, 52', a high current fuse 60 and plug-in receivers 61, 61' which hold the high current fuse 60 between themselves making electrical contact in one alternative configuration of the invention form a fuse means 62 for protecting the plug and socket connection formed by the receiving device 1 between the plugs 51, 51' by way of the sockets 52, 52'. The high current fuse 60 can be formed as a fusible link which is active only when the fuse means 62 is inserted or latched into the receiving device 1.

REFERENCE NUMBER LIST

1 receiving device
1u bottom
1o top
2, 2' receiving contour
3, 3' plug stop
3.1, 3.1' clip
3.2, 3.2' clip
4, 4' fixing feature
4.1, 4.1' catch projection
4.2, 4.2' catch projection
5.1, 5.1' end
5.2, 5.2' end
6, 6' gap
7 connection region
8 cavity
9 carrier
10.1, 10.1' leg
10.2, 10.2' leg
51, 51' L-shaped plug
52, 52' socket
53, 53' line set stop
54, 54' outside contour
55.1, 55.1' projections
55.2, 55.2' projections
56, 56' insertion region
60 high current fuse
61, 61' plug-in receiver
62 bottom part, fuse means
63 peripheral latch means
64 top part
SR insertion direction
LE lengthwise extension

The invention claimed is:

1. A receiving device comprising:

a top portion having a first receiving contour and a second receiving contour configured to receive a first plug connector and a second plug connector, respectively; and a bottom portion configured to accommodate a first socket connector and a second socket connector with a fuse therebetween, wherein the bottom portion is configured to be inserted into the top portion in a first direction and the top portion is configured to connect with the bottom portion by accommodating and latching with the bottom portion, wherein the first and second receiving contours each have plug stops for acting on the first and second plug connectors, respectively, in the first direction, wherein the first and second receiving contours each have fixing features for acting on the first and second plug connectors, respectively, transverse to the first direction, and wherein the receiving device is configured such that the first and second plug connectors are capable of mating with the first and second socket connectors, respectively, upon the connection of the top portion and the bottom portion.

2. The receiving device as claimed in claim 1, configured such that the fuse, when disposed therein, is undetatchably fixed in the receiving device when the top portion is connected to the bottom portion.

3. The receiving device as claimed in claim 1, configured such that the fuse, when disposed therein, is removable from the receiving device when the top portion is not connected to the bottom portion.

4. The receiving device as claimed in claim 1, wherein the top portion further comprises:

an upper part upon which the receiving contours are disposed; and a lower part, opposite the upper part, having a connection region in which connections between the plug connectors and the socket connectors may be formed.

5. The receiving device as claimed in claim 1, wherein the first receiving contour is configured to receive the first plug connector upon insertion of the first plug connector into the first receiving contour in a second direction substantially perpendicular to the first direction, and wherein the second receiving contour is configured to receive the second plug connector upon insertion of the second plug connector into the second receiving contour in a third direction substantially perpendicular to the first direction.

6. The receiving device as claimed in claim 1, wherein the fixing features comprise latch connections, which are configured to act on outside contours of the first and second plug connectors.

7. The receiving device as claimed in claim 1, wherein the fixing features of the first and second receiving contours each comprise two opposite catch projections, which are configured to latch with the first and second plug connectors, respectively, upon insertion of the first and second plug connectors into the first and second receiving contours.

8. The receiving device as claimed in claim 7, wherein the catch projections are arranged such that they are capable of latching with projections on the first and second plug connectors.

9. The receiving device as claimed in claim 1, wherein the plug stops of the first and second receiving contours each comprise at least one clip configured to extend behind the first and second plug connectors, respectively, and act on the first and second plug connectors in the first direction.

10. The receiving device as claimed in claim 1, wherein the plug stops of the first and second receiving contours each comprise at least two L-shaped clips having ends opposite one another with a gap therebetween, and wherein the clips of the first and second receiving contours are configured to extend behind the first and second plug connectors, respectively, and act on the first and second plug connectors in the first direction.

11. The receiving device as claimed in claim 5, wherein the first receiving contour comprises a central axis defining a first line extending in the second direction and the second receiving contour comprises a central axis defining a second line extending in the third direction, wherein the second direction is opposite the third direction, and wherein the first line is parallel to and spaced from the second line.

12. The receiving device as claimed in claim 1, wherein the bottom portion comprises a carrier wherein the top portion comprises a cavity, and wherein the carrier is capable of being inserted into the cavity and latched to the top portion by way of a peripheral catch means.

13. The receiving device as claimed in claim 1, wherein the bottom portion comprises a first cylindrical plug-in receiver and a second cylindrical plug-in receiver disposed flush to one another and opposite one another, and wherein the first and second cylindrical plug-in receivers are configured to accommodate the fuse therebetween.

14. The receiving device as claimed in claim 1, further comprising:

a connector; and a fuse.

15. The receiving device as claimed in claim 1, wherein the top portion comprises catch projections for latching with the first and second plug connectors.

* * * * *